US007905237B2

(12) United States Patent
Noh

(10) Patent No.: US 7,905,237 B2
(45) Date of Patent: Mar. 15, 2011

(54) HAIR BRAIDING MACHINE

(76) Inventor: Jang Sik Noh, Grand Prairie, TX (US)

( * ) Notice: Subject to any disclaimer, the term of this patent is extended or adjusted under 35 U.S.C. 154(b) by 450 days.

(21) Appl. No.: 12/153,000

(22) Filed: May 19, 2008

(65) Prior Publication Data

US 2009/0283107 A1 Nov. 19, 2009

(51) Int. Cl.
*A45D 7/02* (2006.01)
*A45D 7/00* (2006.01)

(52) U.S. Cl. ..... 132/212; 132/210

(58) Field of Classification Search ..... 132/210, 132/212, 273, 271, 56; 87/33, 62
See application file for complete search history.

(56) References Cited

U.S. PATENT DOCUMENTS 4,427,017 A * 1/1984 Eronini ..... 132/271
6,520,187 B1 * 2/2003 Lee et al. ..... 132/212
7,069,935 B2 * 7/2006 Bousfield et al. ..... 132/210
2003/0075198 A1 * 4/2003 Kim et al. ..... 132/210

* cited by examiner

*Primary Examiner* — Rachel R Steitz

(57) ABSTRACT

A hair braiding machine makes it possible to mechanically braid hair in a short period of time and to stably braid hair regardless of the state of hair. The hair braiding machine includes a pair of stationary rotors, which is rotated in opposite directions by driving of a motor and has a plurality of insertion recesses along an outer circumference thereof at regular intervals, a plurality of movable rotors, which is inserted into insertion recesses of the stationary rotors along orbital tracks, makes a circular motion along the orbital tracks by means of a rotating force of the stationary rotors, and includes a fastener at an upper portion thereof to and from which a hair holding unit holding hairs to be braided is coupled and decoupled, and a guide, which is installed at the intersections of circles of an upper orbital hole, changes a path of each movable rotor reaching one of the intersections in a diagonal direction by one of the stationary rotors, and guides the movable rotor, the path of which is changed, to make a circular motion by means of the other stationary rotor.

12 Claims, 18 Drawing Sheets

HAIR BRAIDING MACHINE

BACKGROUND OF THE INVENTION

1. Field of the Invention

The present invention relates to a hair braiding machine, and more particularly to a hair braiding machine, which makes it possible to mechanically braid hair in a short period of time and to stably braid hair regardless of the state of hair.

2. Description of the Prior Art

In general, in order to braid hair, people have no alternative but to manually do so one by one. As such, it takes much time and effort to braid hair.

Thus, an apparatus for braiding hair by machine rather than by hand is disclosed in Korean Patent Application Publication No. 2001-0076807.

However, this hair braiding apparatus has several problems from the viewpoint of usage. First, due to a complicated structure, the cost of production is high. In particular, since the apparatus employs a cam driving system, there is a limitation to a speed. Thus, it still takes much time to braid hair.

Further, the apparatus has no separate mechanism for clamping hairs, and thus adjusts a speed of feeding the hairs depending on only friction between a rubber tube and the hairs. For this reason, when the rubber tube is used, it is inconvenient to properly select one of the rubber tubes according to hair's diameter and number.

Furthermore, although the proper rubber tube is selected in order to braid the hair into several sections, three parts, i.e. a root part, an intermediate part and an end part, of each section of the hair are different from each other in the number of hairs. Especially, in the case of long hair, short hairs are mostly intervened between long hairs. Thus, as the hair is braided down, the number of hairs is gradually reduced, so that a frictional force between the hair and the rubber tube is decreased. As a result, some hairs easily escape from the rubber tube, and thus it is difficult to perfectly braid the hair to the end.

In addition, a hair fixture is designed to be able to adjust its length like an antenna, so that it gets the hairs into tangles therein when operated.

SUMMARY OF THE INVENTION

Accordingly, the present invention has been made keeping in mind the above problems occurring in the prior art, and an object of the present invention is to provide a hair braiding machine, which makes it possible to mechanically braid hair in a short period of time, to adjust a hair braiding speed during operation as needed, and to conveniently and stably braid hair regardless of the state of hair.

In order to achieve the above object, according to the present invention, there is provided a hair braiding machine, which comprises: a housing, which includes a motor mounted therein, a controller controlling a driving force of the motor, and orbital holes formed at an upper end thereof and having two circles having an identical diameter are open in a partly overlapping form; a pair of stationary rotors, which is installed at centers of the circles of each orbital hole such that orbital tracks are defined between the orbital hole and the stationary rotors, is rotated in opposite directions by driving of the motor, and has a plurality of insertion recesses along an outer circumference thereof at regular intervals; a plurality of movable rotors, which is inserted into the insertion recesses of the stationary rotors along the orbital tracks, makes a circular motion along the orbital tracks by means of a rotating force of the stationary rotors, and includes a fastener at an upper portion thereof to and from which a hair holding unit holding hairs to be braided is coupled and decoupled; and a guide, which is installed at intersections of the circles of the upper orbital hole, changes a path of each movable rotor reaching one of the intersections in a diagonal direction by one of the stationary rotors, and guides the movable rotor, the path of which is changed, to make a circular motion by means of the other stationary rotor.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Reference will now be made in greater detail to exemplary embodiments of the invention with reference to the accompanying drawings.

A hair braiding machine according to an embodiment of the present invention generally comprises a machine body 100, and a hair holding unit 200 separated from the machine body 100. The hair holding unit 200 is detachably installed on the machine body 100.

Figure 1:
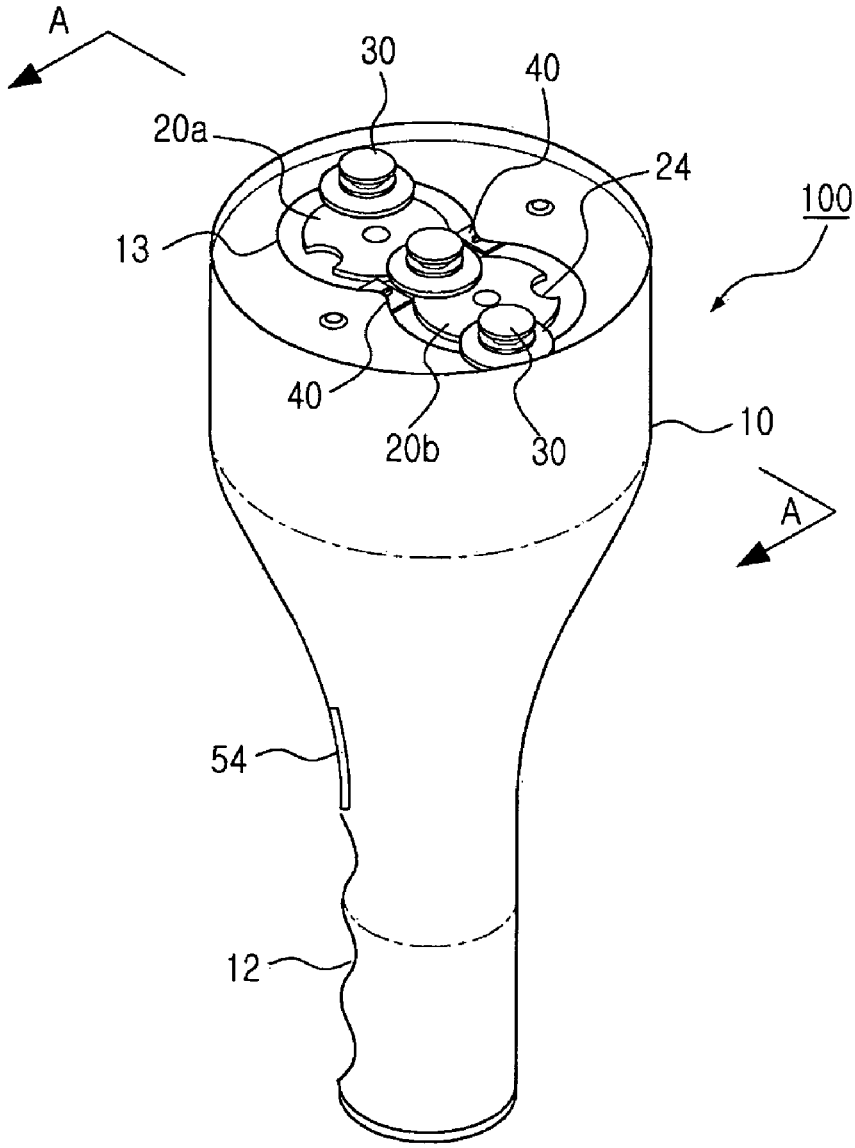
FIG. 1 is a perspective view illustrating a machine body according to an embodiment of the present invention.
Figure 2:
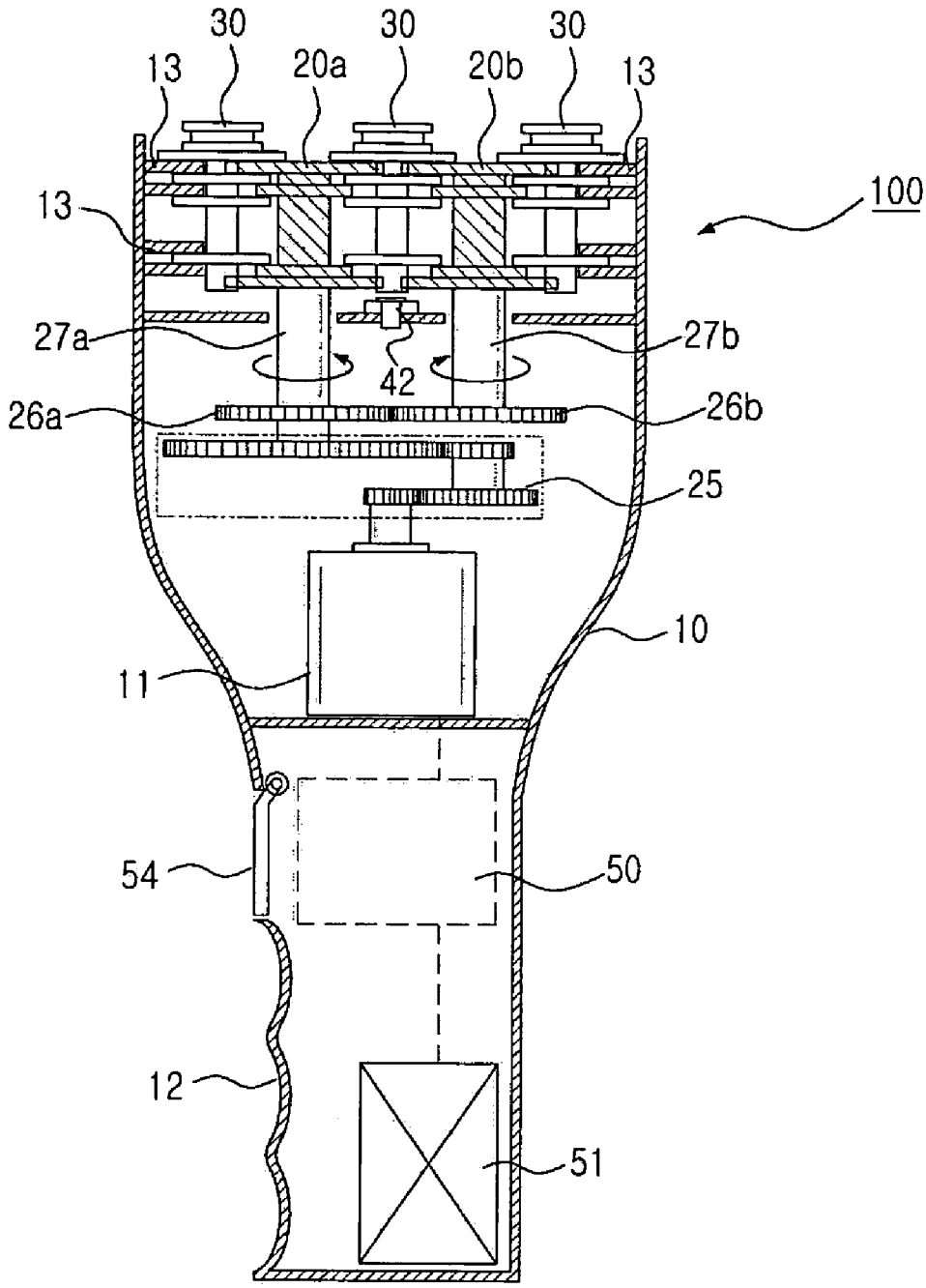
FIG. 2 is a cross-sectional view taken along the line A-A of FIG. 1.
Figure 3:
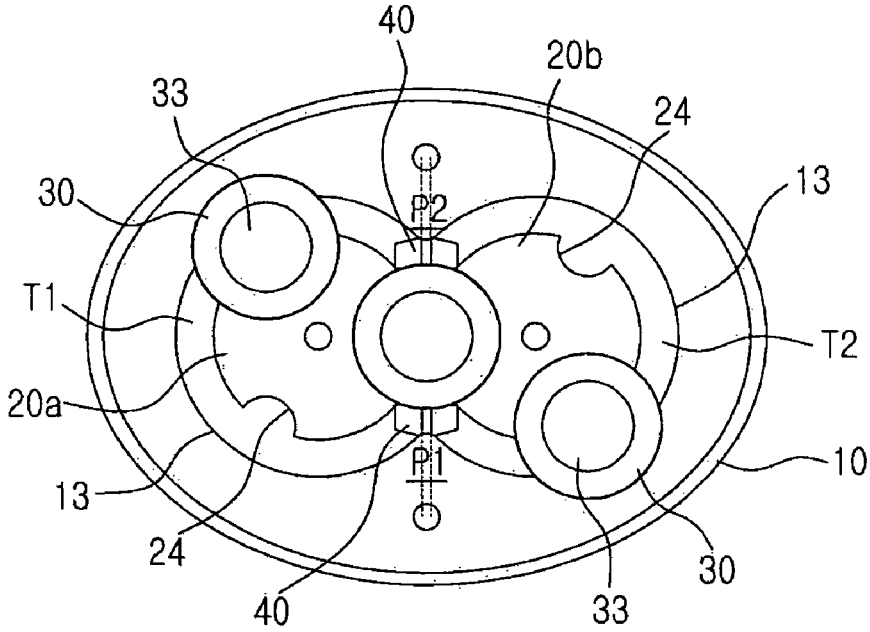
FIG. 3 is a top plan view of FIG. 1.

FIG. 1 is a perspective view illustrating a machine body, FIG. 2 is a cross-sectional view taken along the line A-A of FIG. 1, and FIG. 3 is a top plan view of FIG. 1. Referring to these figures, the machine body 100 includes a hollow housing 10, in which a motor 11, a drive source, is mounted.

The housing 11 is provided with a grip 12, at a lower portion thereof, which a plurality of waveforms are continuously formed on an outer circumferential surface thereof. The grip 12 enables a user to easily grasp the housing 10 when used.

The housing 10 is provided with orbital holes 13 at an upper end thereof.

Each orbital hole 13 has a structure in which two circles having the same diameter partly overlap with each other. Thus, each orbital hole 13 has two intersections P1 and P2 at which the two circles intersect.

These orbital holes 13 are preferably formed up and down in pairs with movable rotors 30 in between so as to be able to more firmly support the movable rotors 30.

A pair of stationary rotors 20*a* and 20*b*, which is rotated by a driving force of the motor 11, is installed at centers of the circles of each orbital hole 13.

In order to transmit the driving force of the motor 11 to the stationary rotors 20*a* and 20*b*, the motor 11 is coupled with a reduction gear train 25, which reduces the driving force of the motor 11.

The reduction gear train 25 cooperates with a terminal gear serving as a driving gear 26*a*. The driving gear 26*a* is engaged with a driven gear 26*b* having the same size of the driving gear 26*a*.

The driving and driven gears 26*a* and 26*b*, which are engaged with each other, are coupled with respective rotating shafts 27*a* and 27*b*, which are disposed in parallel in a vertical direction. The rotating shafts 27*a* and 27*b* are coupled to lower ends of the respective stationary rotors 20*a* and 20*b*.

Thus, the stationary rotors 20*a* and 20*b* coupled to the rotating shafts 27*a* and 27*b* rotate at the same rotation speed in opposite directions.

Figure 4:
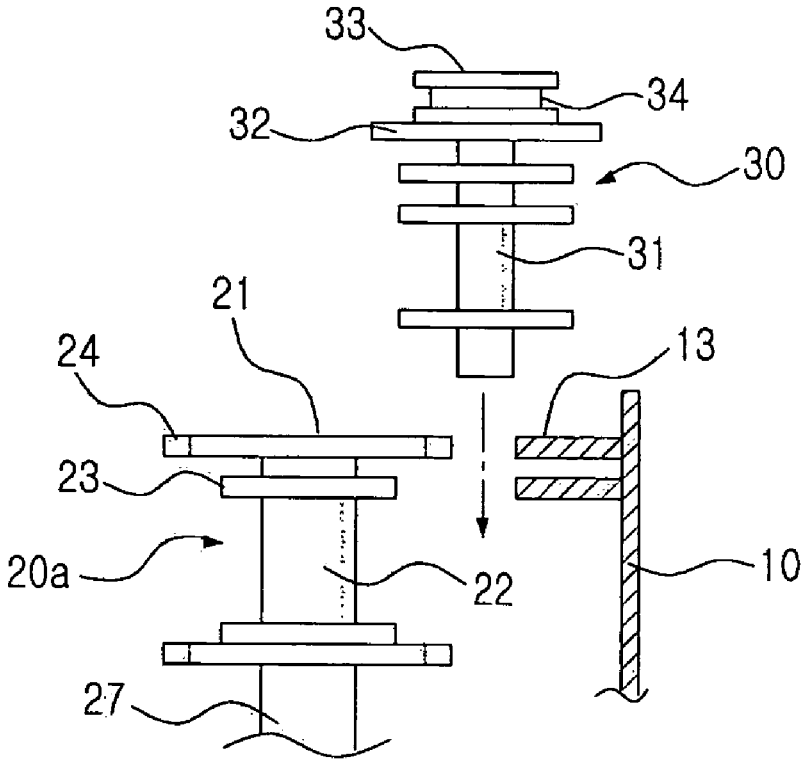
FIG. 4 is a detailed view illustrating a stationary rotor and a movable rotor according to an embodiment of the present invention.

FIG. 4 is a detailed view illustrating the stationary rotors 20*a* and 20*b*. Referring to FIG. 4, each of the stationary rotors 20*a* and 20*b* is designed so that a pair of parallel rotating plates 21 is coupled with a shaft 22, and that a reinforcement plate 23 is installed on the shaft 22 below the upper rotating plate 21, so that an insertion space is defined between the upper rotating plate 21 and the reinforcement plate 23.

Each rotating plate 21 includes semi-circular insertion recesses 24 along the circumference thereof at regular intervals. The movable rotors 30 are inserted into the insertion recesses 24.

Here, three insertion recesses 24 are formed in each rotating plate 21 at an angle of 120°. Two of the insertion recesses 24 face each other on an imaginary line connecting the centers of the opposite rotating plates 21, thereby forming a circular shape.

All the rotating plates 21 have the same diameter, which is smaller than each circle of the orbital hole 13.

Thus, a predetermined spacing is defined between the outer circumference of each rotating plate 21 and the inner circumference of each orbital hole 13, so that two orbital tracks T1 and T2, along which the movable rotors 30 can move, are formed on opposite sides of the intersections P1 and P2.

The movable rotors 30 make a circular motion along the orbital tracks T1 and T2 by means of the rotating force of the stationary rotors 20*a* and 20*b*.

The movable rotors 30 are three in number, and are preferably installed at positions where the orbital tracks T1 and T2 are divided into three equal parts.

Referring to FIG. 4, each movable rotor 30 includes a supporting plate 32, which is installed on a central shaft 31 having a predetermined length, is inserted between an insertion space between each movable rotor 30 and each orbital hole 13, and is supportably installed on the orbital track T1 or T2.

Further, each movable rotor 30 includes a protruding fastener 33, to which the hair holding unit 200 is detachably installed, at an upper end thereof. The fastener 33 includes a groove 34.

The central shafts 31 of the movable rotors 30 are inserted into the insertion recess 24 of the rotating plates 20, and thus the movable rotors 30 make a circular motion along the orbital tracks T1 and T2 by means of the rotating force of the stationary rotors 20*a* and 20*b*.

At this time, the movable rotors 30 make a "figure-of-eight" motion, because motion paths thereof are changed by a guide 40 when reaching the intersections P1 and P2 of the orbital tracks T1 and T2.

To this end, the guide 40 includes a pair of swing plates 41 and a swing lever 42 connected to lower sides of the swing plates 41.

Figure 5:
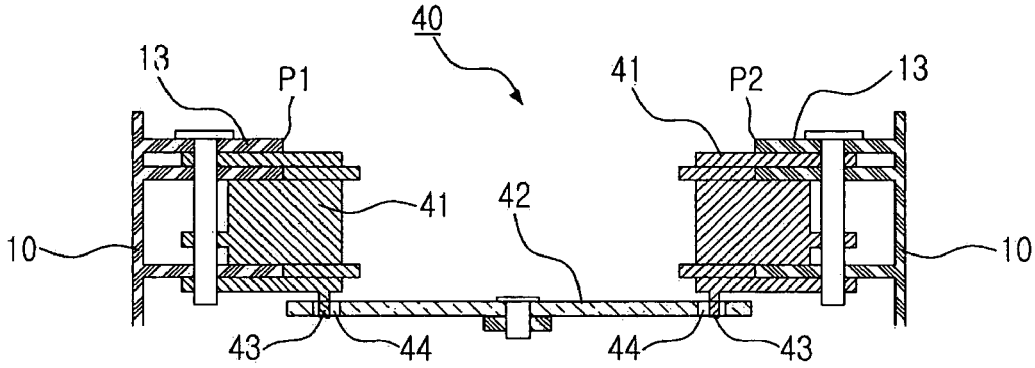
FIG. 5 is a cross-sectional view illustrating a guide according to an embodiment of the present invention.

FIG. 5 is a cross-sectional view illustrating the guide 40. The swing plates 41 are pivotably hinged to the upper end of the housing 10 at the intersections P1 and P2 of the upper orbital hole 13, and include lever pins 43 protruding downwards at lower ends thereof.

The swing plates 41 protrude toward the orbital tracks T1 and T2 so as to be able to contact the movable rotors 30 at the intersections P1 and P2.

The swing lever 42 includes pin holes 44 into which the lever pins 43 of the swing plates 41 are inserted at opposite ends thereof, and is installed so as to be able to move around its center in leftward and rightward directions.

This guide 40 is designed so that the first swing plate 41 is pushed to rotate the swing lever 42 by one of the movable rotors 30 reaching the first intersection P1 while making a circular motion by means of the rotating force of the left-hand stationary rotor 20*a*, and that the second swing plate 41 is rotated in a direction opposite the first swing plate 41 at the second intersection P2.

Thus, the movable rotor 30, which passes through the first intersection P1 while pushing the first swing plate 41, is subjected to a change in the path of the circular motion due to the second swing plate 41, which has been rotated in the opposite direction to block the path of the circular motion. Then, the movable rotor 30 is inserted into the insertion recess 24 of the right-hand stationary rotor 20*b*, and continues the circular motion in the opposite direction by means of the right-hand stationary rotor 20*b*.

In other words, the guide 40 guides the movable rotor 30, which is in circular motion in one direction by means of the left-hand stationary rotor 20*a*, to the right-hand stationary rotor 20*b*, thereby enabling the movable rotor 30 to make the circular motion in the other direction. Accordingly, the guide 40 functions to move the movable rotor 30 in the "figure-of-eight" shape.

Figure 6:
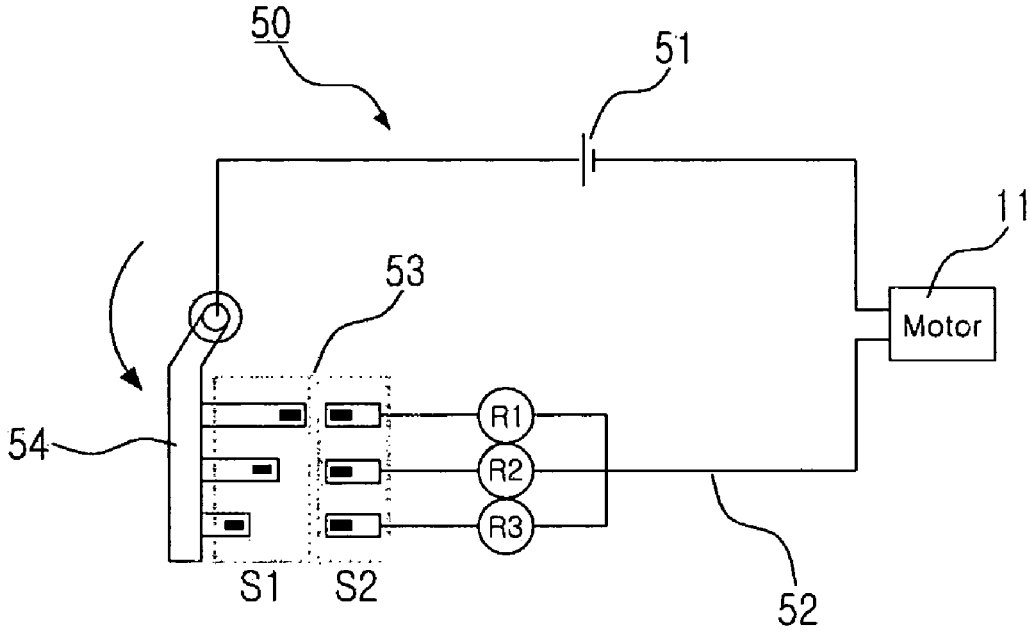
FIG. 6 illustrates the configuration of a controller according to an embodiment of the present invention.

FIG. 6 is a circuit diagram illustrating a controller 50. The machine body 100 is preferably equipped with the controller 50 for controlling the driving force of the motor 11 as the driving source. The controller 50 is adapted so that the user can control the speed at which the hair is braided by adjusting magnitude of power applied to the motor.

To this end, the controller 50 comprises a power supply 51 and a plurality of power supply circuits 52 electrically connecting the power supply 51 and the motor 11. The power supply circuits 52 are connected with different resistors R and a switchboard 53.

The switchboard 53 includes a plurality of pairs of contacts S1 and S2, which are connected with or disconnected from each other, are connected to the power supply circuits 52, and are arranged in parallel at regular intervals, and an operation switch 54, to which the first contacts S1 are connected.

The operation switch 54 is pivotably hinged to the inside of the housing 10 at one end thereof when pressed. The first contacts S1 are arranged in parallel on an inner surface of the operation switch 54 in a vertical direction.

At this time, the first contacts S1 are disposed so that their lengths are gradually reduced from the uppermost contact to the lowermost contact. The resistors R of the power supply circuits 52 are connected to the respective second contacts S2 in a manner such that their resistance values are gradually reduced from the uppermost resistor R1 to the lowermost resistor R3 in proportion to the lengths of the first contacts S1.

As a rotation angle of the pressed operation switch 54 increases, the first contacts S1 are sequentially brought into contact with the second contacts starting with the uppermost contact. Thus, the magnitude of the power applied to the motor 11 is gradually increased, and thereby the driving force of the motor 11 is gradually increased.

Although the embodiment has been described that three pairs of contacts S1 and S2 are arranged to control the speed of the motor 11 in three steps, it will be apparent that the speed control steps of the motor 11 can be changed by increasing or decreasing the number of the paired contacts S1 and S2.

Figure 7:
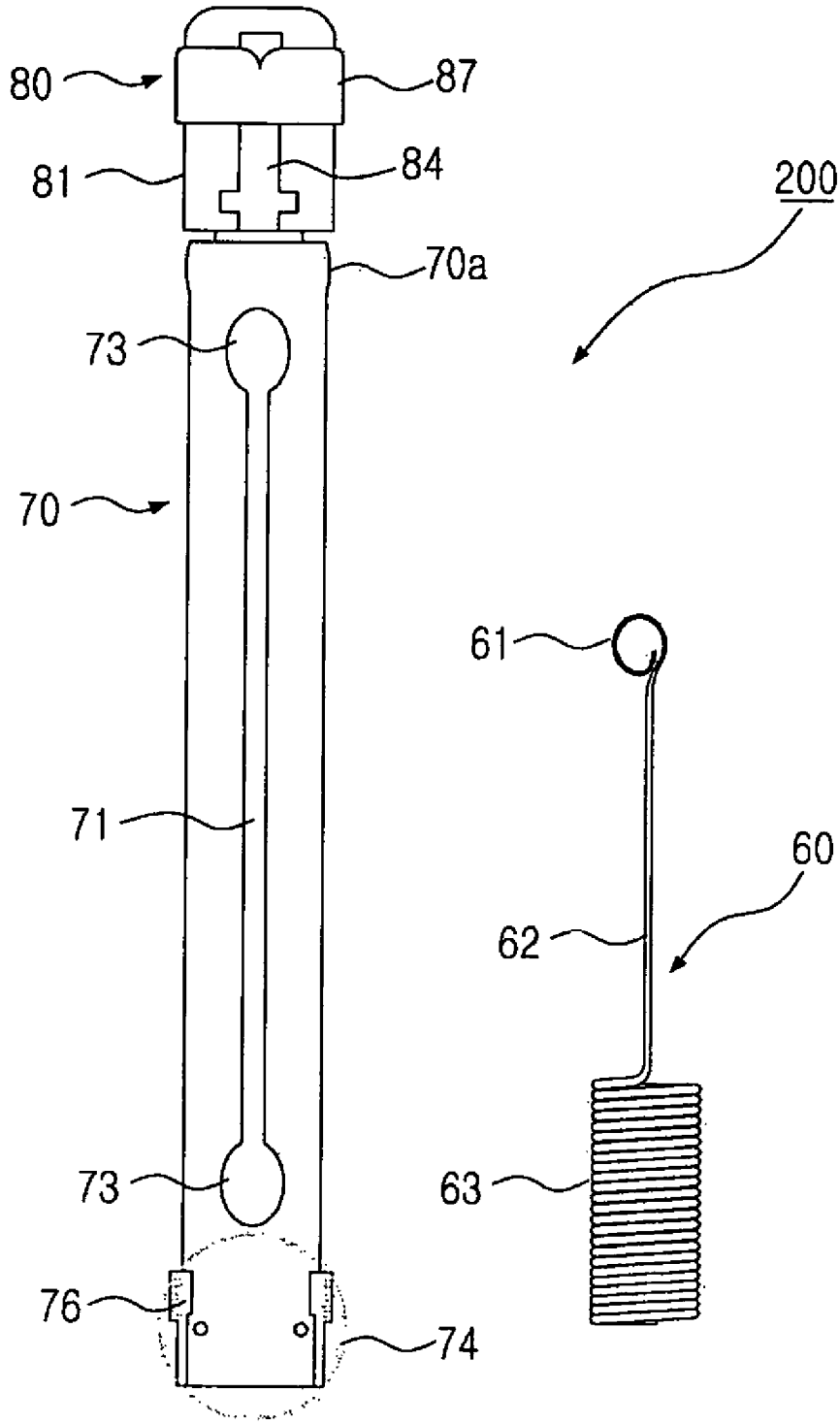
FIG. 7 illustrates the configuration of a hair holding arm according to an embodiment of the present invention.

FIG. 7 illustrates configuration of the hair holding unit 200 that is detachably installed on the machine body 100.

As illustrated in FIG. 7, the hair holding unit 200 comprises a hair holder 60 into which the hairs are inserted, a hair holding arm 70 in which the hairs are held and retained, and a grasper 80 which grasps the hairs.

The hair holder 60 includes a ring 61, in which the hairs to be braided are held, at the first end of a rod 62, and a grip 63 grasped by the user at a second end of the rod 62.

This hair holder 60 makes use of a wire having high elasticity. Preferably, the grip 63 is injection-molded so as to make free bending possible or is formed in a nearly cylindrical shape by closely winding the wire.

The ring 61 is preferably formed by winding the wire in a circular or elliptical shape such that the hairs do not easily come out after they are held. To this end, as illustrated in FIG. 7, the ring 61 is formed by winding the wire either one turn or one turn and a quarter.

The hair holding arm 70 has the shape of a hollow cylinder having a predetermined length, and includes a socket 70*a* for connection with the grasper 80 at an upper end thereof, and a holder slit 71 which is elongately cut out in a longitudinal direction such that the hair holder 60 can come in and out.

Figure 8:
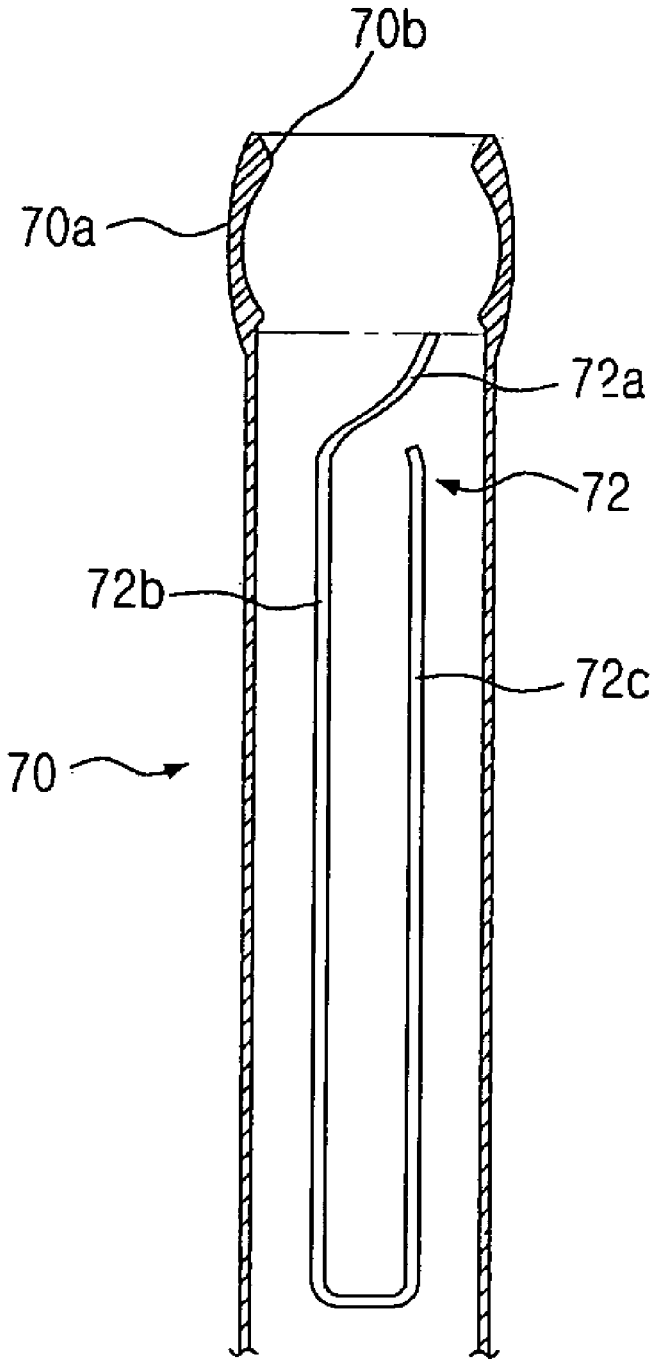
FIG. 8 is a cross-sectional view illustrating the hair holding arm of FIG. 7.

FIG. 8 is a cross-sectional view illustrating the hair holding arm 70. The hair holding arm 70 includes the socket 70*a* into which the grasper 80 is inserted at the upper end thereof, and a guide wall 72 partitioning the interior thereof in a longitudinal direction.

The socket 70*a* is curved in an outward direction when viewed in cross section, and has a protruding round step 70*b* at an upper end thereof.

The guide wall 72 includes an inclined wall 72*a* inclined from a lower end of the socket 70*a* in a downward direction, a left-hand wall 72*b* extending from the inclined wall 72*a* in a direct downward direction, and a right-hand wall 72*c* bent at a lower end of the left-hand wall 72*b* and then extending to the proximity of the inclined wall 72*a* parallel to the left-hand wall, and thus partitions the interior of the hair holding arm 70 into three equal parts.

This guide wall 72 serves to easily hold and retain long hairs in the hair holding arm 70 having a relatively short length when the long hair is to be braided.

In other words, the hair holder 60 introduced into the holder slit 71 with the hairs held moves up and down along a reciprocating path defined by the guide wall 72, so that the hairs are held along the reciprocating path.

The holder slit 71 has expansion holes 72 at upper and lower ends thereof, which communicate with the holder slit 71 and have the same shape.

The expansion holes 72 function to allow the hair holder 60 to more easily move up and down by expanding the relatively narrow holder slit 71 when the hair holder 60 is reciprocated in the holder slit 71.

The hair holding arm 70 is provided with a coupler 74 at a lower end thereof which couples and decouples the hair holding arm 70 to and from each movable rotor 30 of the machine body 100.

Figure 9A:
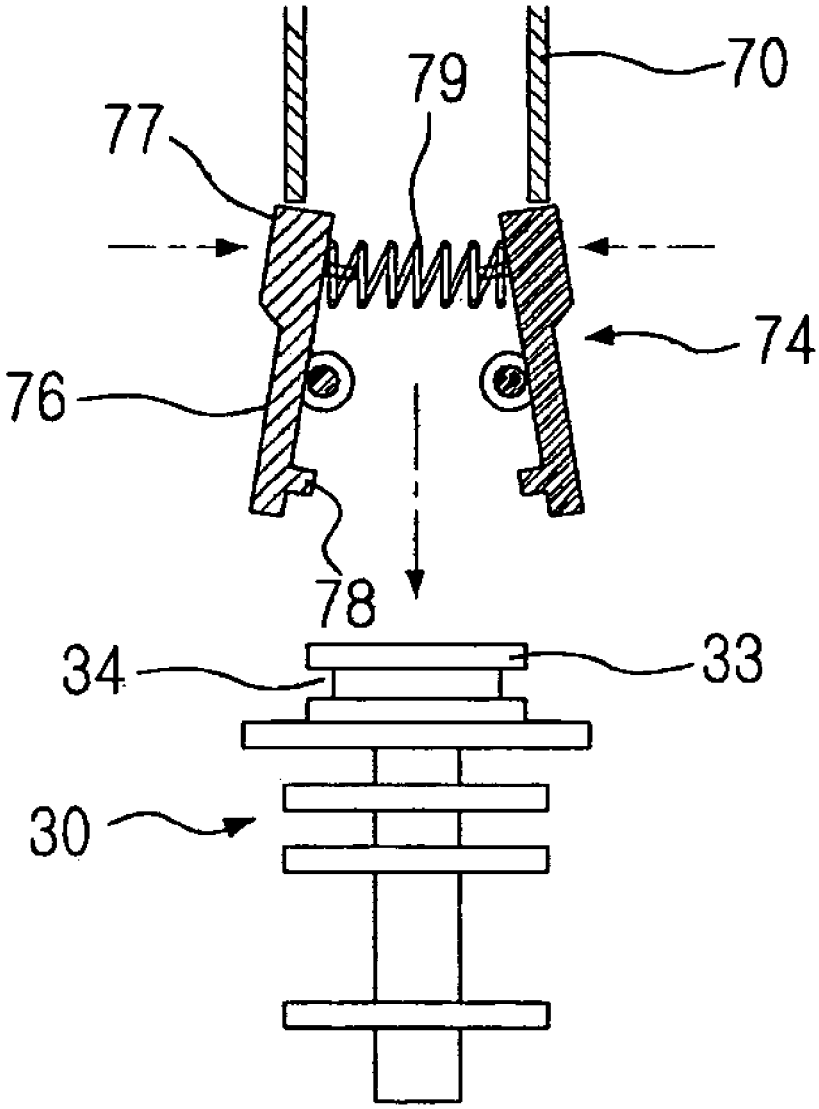
FIGS. 9A and 9B illustrate operation of the coupler of FIG. 7.
Figure 9B:
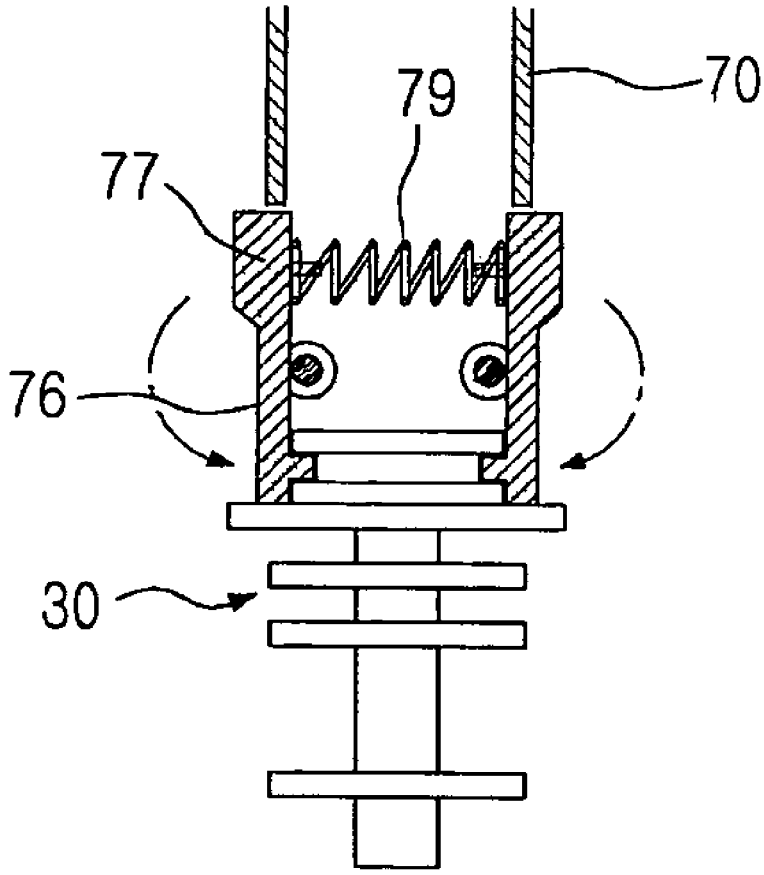

FIGS. 9A and 9B are cross-sectional views illustrating the coupler 74. The coupler 74 includes at least one seat (not shown) recessed inward at the lower end of the hair holding arm 70. The fastener 33 of each movable rotor 30 is inserted into the seat.

A pair of coupling buttons 76 is rotatably installed on the opposite sides of the seat.

Each coupling button 76 has a pressing part 77 protruding outward from an upper portion thereof, and a locking part 78 protruding inward from a lower portion thereof. A spring 79 is installed between the pressing parts 77.

As illustrated in FIG. 9A, the pressing parts 77 of this coupler 74 are pressed to compress the spring 79, and thereby the coupling buttons 76 are rotated to become open. Then, the hair holding arm 70 moves down to the fastener 33 of the movable rotor 30. Subsequently, when the pressing parts 77 are in an unpressed state, the coupling buttons 76 return to their original positions by means of recovery force of the compressed spring 79. As illustrated in FIG. 9B, the locking parts 78 of the coupling buttons 76 are inserted into the groove 34 of the fastener 33, so that the hair holding arm 70 is coupled to the movable rotor 30.

The grasper 80 is coupled to and communicates with the upper end of the hair holding arm 70.

Figure 10:
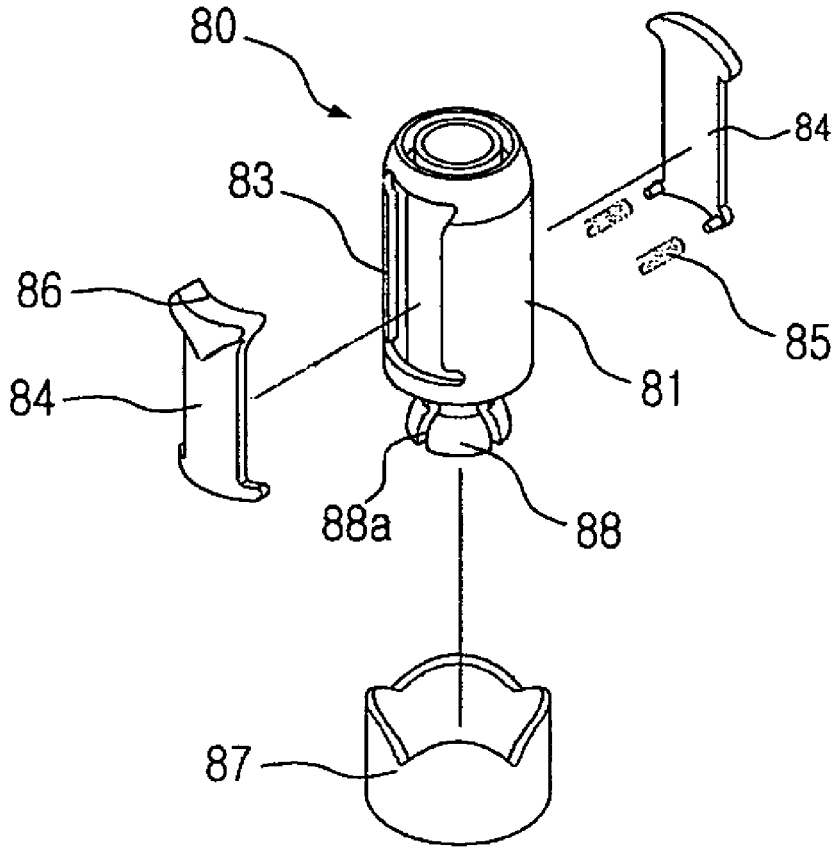
FIG. 10 is an exploded perspective view illustrating the grasper of FIG. 7.

FIG. 10 is an exploded perspective view illustrating the grasper 80. As illustrated in FIG. 10, the grasper 80 serves to grasp the hairs held in the hair holding arm 70 so as to prevent the hairs from escaping, and includes an elastic tube 82 in a hollow casing 81.

The casing 81 and the elastic tube 82 are open at upper and lower ends thereof such that the hairs can be guided through the upper ends thereof into the hair holding arm 70 that communicates therewith through the lower ends thereof.

The elastic tube 82 is preferably formed of material such as rubber or silicon, which has softness, a high friction coefficient, and a predetermined elastic force.

The casing 81 is provided with cutout recesses 83 having an approximately rectangular shape in an outer circumference thereof in a diametrical direction. A pair of fingers 84 is pivotably coupled to hinge shafts of the casing 81 at longitudinal middle portions of the cutout recesses 83 so as to face each other.

The pair of fingers 84 is connected to each other with springs 85 interposed between lower ends thereof, and includes pressing knobs 86 protruding inward from upper ends thereof.

Here, each spring 85 preferably has such elastic strength that the hairs can be grasped and that the hairs held in the hair holding arm 70 can slowly come out when braided by the operation of the machine body 100.

Each finger 84 has an inclined outer surface 84*a* so as to be symmetrical with respect to each hinge shaft. Preferably, the inclined outer surface 84*a* has an approximately V shape in whole.

A slider 87 is installed on the outer circumference of the casing 81, to which the pair of fingers 84 is pivotably coupled in a diametrical direction as described above, so as to be able to slide up and down.

Figure 11A:
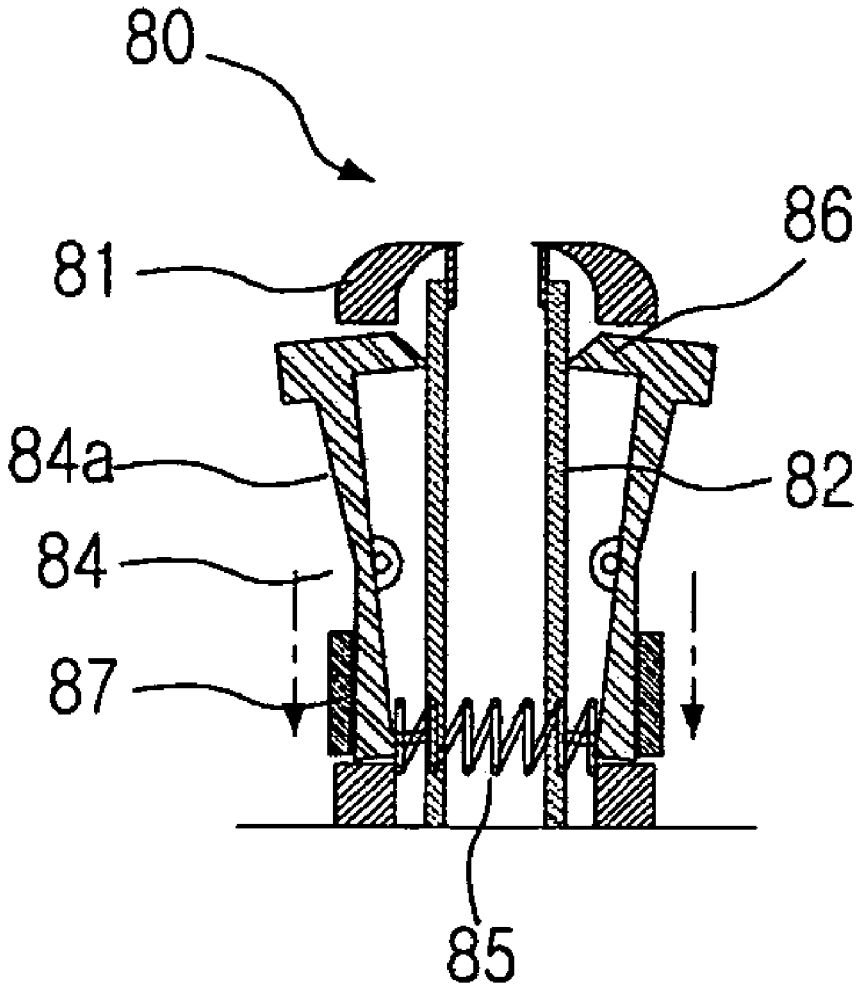
FIGS. 11A and 11B illustrate operation of the grasper of FIG. 7.
Figure 11B:
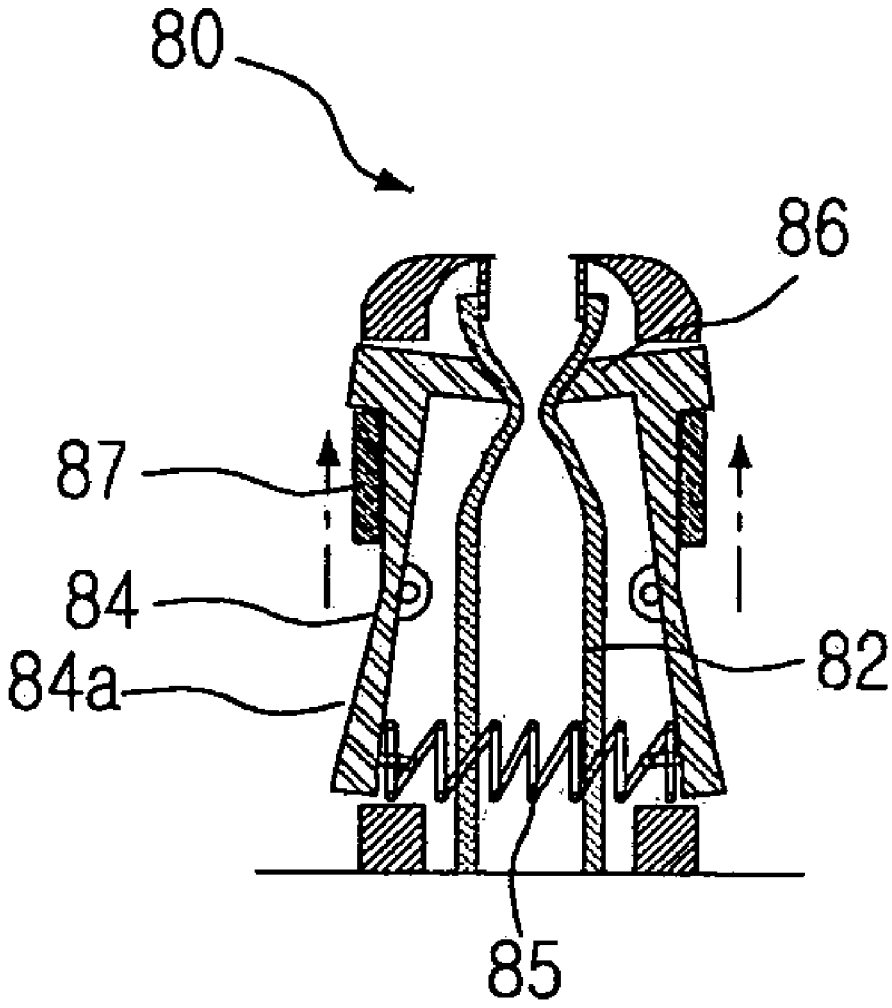

FIGS. 11A and 11B are cross-sectional views illustrating operation of the slider 87.

As illustrated in FIG. 11A, the outer surface of each finger 84 contacting an inner circumference of the slider 87 has the V shape. Thus, when the slider 87 moves downward, the lower portions of the fingers 84 are pressed and pivoted by the slider 87.

As the fingers 84 are pressed and pivoted by the slider 87, the springs 85 installed on the lower ends of the fingers 84 are compressed, and simultaneously the pressing knobs 86 protruding inward from the upper ends of the fingers 84 move away from each other. This operation causes the elastic tube 82 to be in an opened state.

As illustrated in FIG. 11B, when the lowered slider 87 moves upward, the force applied to the fingers 84 is released.

As the pressing of the slider 84 is released, the compressed springs 85 are recovered by the elastic force thereof, and thus the fingers 84 are pivoted in the inward directions. Thereby, the pressing knobs 86 of the upper ends of the fingers 84 are pressed so as to compress the elastic tube 82.

In this manner, the pressing knobs 86 compress the elastic tube 82 by the elastic force of the springs 85, so that the hairs introduced into the elastic tube 82 are grasped to some extent so as to be prevented from escaping by the elastic force of the springs 85 and the frictional force of the elastic tube 82.

Meanwhile, the casing 81 has a plug 88 protruding from the lower end thereof. The plug 88 is inserted into the socket 70*a* of the hair holding arm 70, and thus couples the grasper 80 to the hair holding arm 70.

The plug 88 has the shape of an approximate hemisphere whose upper portion has a smaller cross section, and is formed so that a lower end thereof has a greater diameter than the round step 70*b* of the hair holding arm 70, and includes a plurality of slots 88*a*, which is cut out in a vertical direction, in an outer circumference thereof.

When inserted, the plug 88 is compressed by the round step 70*b* of the socket 70*a*. At this time, the slots 88*a* are pressed, and thus the diameter of the plug 88 is reduced in whole. Thereby, the plug 88 is received in the curved portion of the socket 70*a*. After inserted, the diameter of the plug 88 is increased, and thus is prevented from escaping from the socket 70*a*.

As the plug 88 is coupled in this way, the grasper 80 can be pivoted as a predetermined angle with respect to the hair holding arm 70 on all sides (i.e. in all directions). The grasper 80 is inclined toward the roots of the hairs at a predetermined angle during braiding the hair, so that the hair can be more neatly braided from beginning to end.

Since the hair holding units 200 configured as described above are coupled to and decoupled from the respective movable rotors 30, the number of hair holding units 200 is preferably three.

The operation and usage of the exemplary embodiment of the present invention configured as described above will be described below.

First, the user moves the slider 87 of the grasper 80 in a downward direction such that the upper end of the grasper 80 is open.

Then, the user holds the grip 63 of the hair holder 60 to guide the hair holder 60 into the hair holding arm 70 through the upper expansion hole 73 of the hair holding arm 70.

At this time, the hair holder 60 is guided until the ring 61 of the first end thereof is exposed to the outside of the upper end of the grasper 80 through the elastic tube 82 of the grasper 80 communicating with the hair holding arm 70.

In this state, the user roughly divides the hairs to be braided into three equal parts, thereby making three bundles of hairs. Then, each hair bundle is inserted into the ring 61 of the hair holder 60 exposed to the outside of the upper end of the grasper 80.

The user guides the hair holder 60, into which the hair bundle is inserted, along the inner guide wall 72 through the holder slit 71 such that the hair bundle inserted into the ring 61 is wound in the hair holding arm 70.

In this manner, when the hair bundle to be braided is completely held in the hair holding arm 70, the user moves the slider 87 of the grasper 80 in an upward direction.

When the slider 87 is raised, the pressing knobs 86 of the fingers 84 presses the elastic tube 82, through which the hair bundle passes, by means of the elastic force of the springs 85, as described above. Thus, the hair bundle held and retained in the hair holding arm 70 is prevented from escaping due to the elastic force.

After the hair bundle held and retained, the hair holder 60 is separated from the hair bundle inserted into the ring 61, and then is withdrawn from the hair holding arm 70 to the outside.

This process is repeated three times, so that three bundles of hairs are held in three hair holding units 200.

Afterwards, the hair holding units 200 are coupled to the upper ends of the respective movable rotors 30 of the machine body 100.

In this state, when the operation switch 54 of the controller 50 is pressed, the power of the power supply 51 is supplied to the motor 11, and thus the motor 11 is driven.

At this time, the driving force of the motor 11 is gradually increased as described above. In detail, when the operation switch 54 is pressed, the upper contact of the switchboard 53 is connected first. Thus, the power supply circuit having the highest resistance R1 is connected, so that the motor 11 is driven at a low speed. As the operation switch 54 is further pressed to increase its pivoting angle, the power supply circuit having the gradually decreasing resistance is connected, so that the driving force of the motor 11 is gradually increased.

The driving force of the motor 11 is reduced by the reduction gear train 25, and then is transmitted to the rotating shafts 27*a* and 27*b*. The pair of stationary rotors 20*a* and 20*b* coupled to the upper ends of the respective rotating shafts 27*a* and 27*b* are rotated in opposite directions. For example, the left-hand stationary rotor 20*a* is rotated in a counterclockwise direction, while the right-hand stationary rotor 20*b* is rotated in a clockwise direction.

As the stationary rotors 20*a* and 20*b* are rotated, the three movable rotors 30 installed on the orbital tracks T1 and T2, particularly inserted into the insertion recesses 24 of the stationary rotors 20*a* and 20*b*, initiate circular motion along the orbital tracks T1 and T2 at the same time.

The circular motion path of each movable rotor 30 is changed at the intersections P1 and P2 by the guide 40, so that the movable rotors 30 move in the opposite directions while crossing the circles of the orbital tracks T1 and T2 (i.e. "figure-of-eight" type motion).

FIGS. 12A through 12E are operation diagrams illustrating motion of the movable rotors 30 step by step. The motion of the movable rotors 30 will be described below in detail with reference to these figures.

Figure 12A:
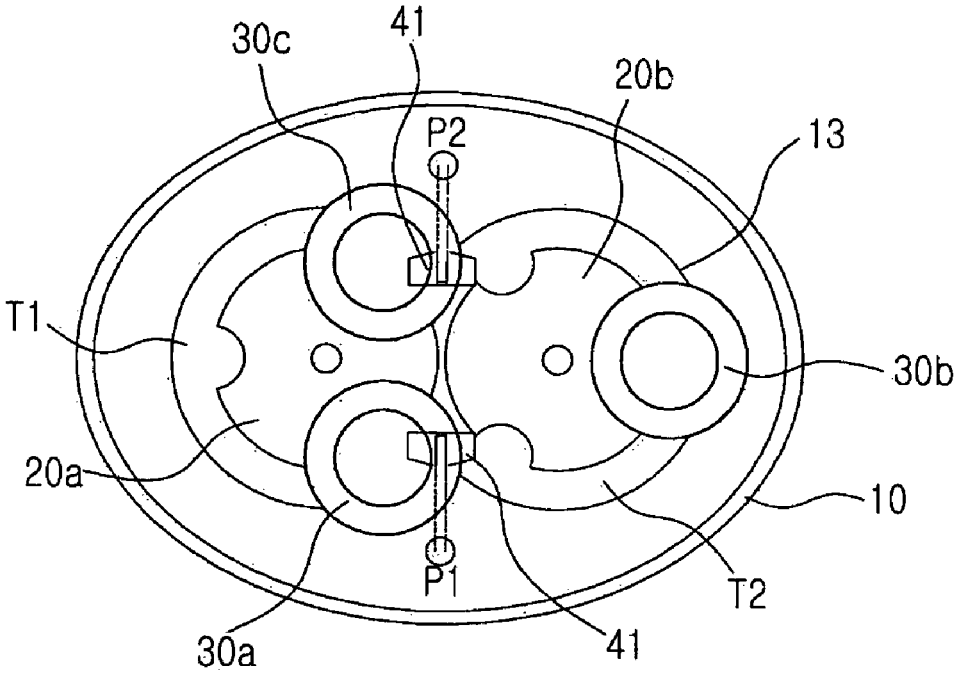
FIGS. 12A through 12E are operation diagrams illustrating motion of the movable rotors step by step according to an embodiment of the present invention.
Figure 12B:
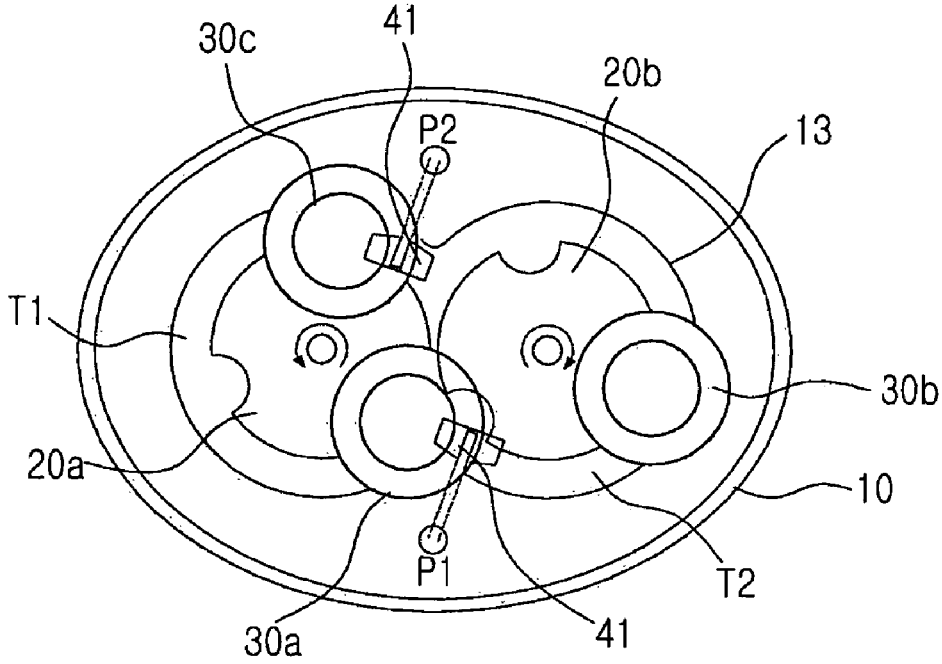
Figure 12C:
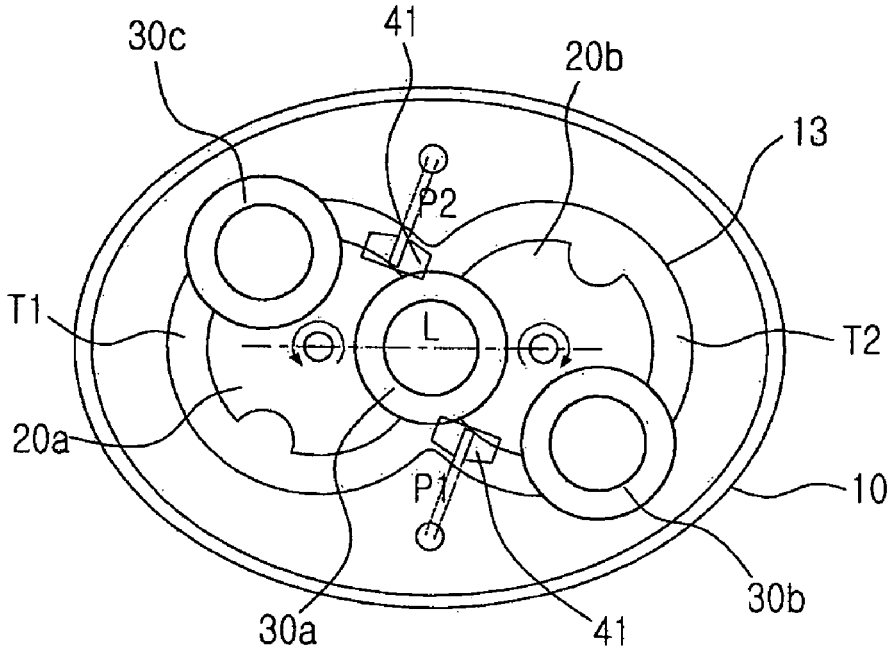
Figure 12D:
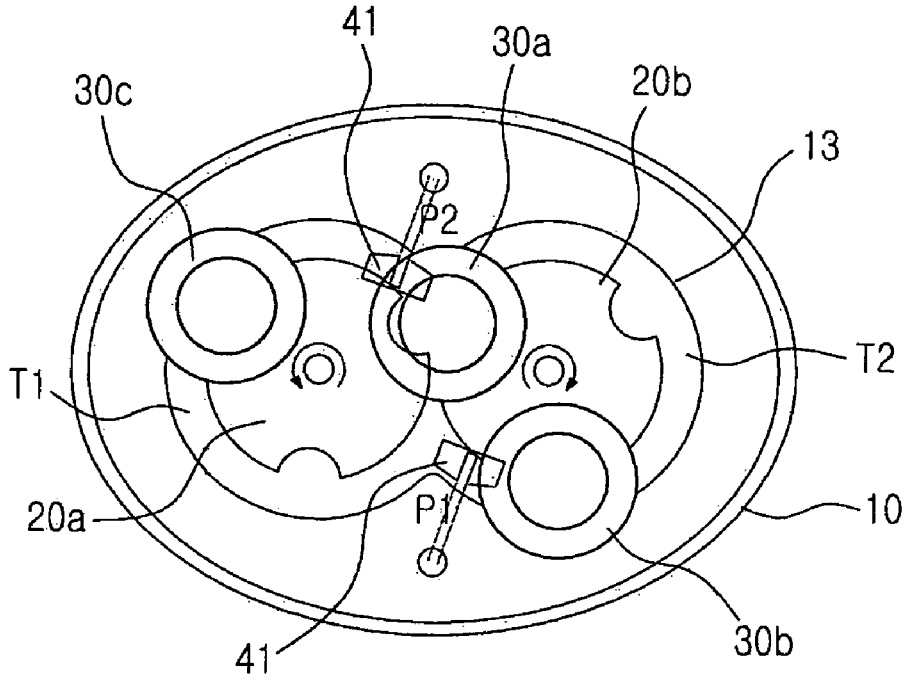

The three movable rotors 30 initiate circular motion at the respective positions where the whole of the orbital tracks T1 and T2 is approximately divided into three equal parts (see FIG. 12A).

The first movable rotor 30*a* nearest the intersection P1 makes a circular motion in a counterclockwise direction by the left-hand stationary rotor 20*a*, and then pushes the first swing plate 41 at the intersection P1 in a rightward direction. Simultaneously, the second swing plate 41 is pushed in a leftward direction by the swing lever 42 (see FIG. 12B).

The first movable rotor 30*a*, which has past through the first swing plate 41, continues to move in the counterclockwise direction, and then reaches the position of a central line L of connecting the centers of the opposite stationary rotors 20*a* and 20*b*. At this time, as described above, the insertion recess 24 of the right-hand stationary rotor 20*b* rotating in a clockwise direction also reaches the position of the central line L at the same time. Thus, the first movable rotor 30*a* is positioned in a circle, which is defined when the insertion recesses 24 of the opposite stationary rotors 20*a* and 20*b* meet each other (see FIG. 12C).

As soon as the first movable rotor 30*a* passes through the central line L, the path of the circular motion of the first movable rotor 30*a* is interrupted by the second swing plate 41, which has already been rotated in a leftward direction. Thereby, the first movable rotor 30*a* moves out of the insertion recess 24 of the left-hand stationary rotor 20*a*, and moves toward the insertion recess 24 of the right-hand stationary rotor 20*b*. Thus, the first movable rotor 30*a* makes a circular motion in a clockwise direction by the right-hand stationary rotor 20*b* (see FIG. 12D).

Further, after the path of the first movable rotor 30*a* is changed, the second movable rotor 30*b* adjacent to the intersection P1 continues the circular motion by means of the right-hand stationary rotor 20*b*, and thus reaches the intersection P1.

Figure 12E:
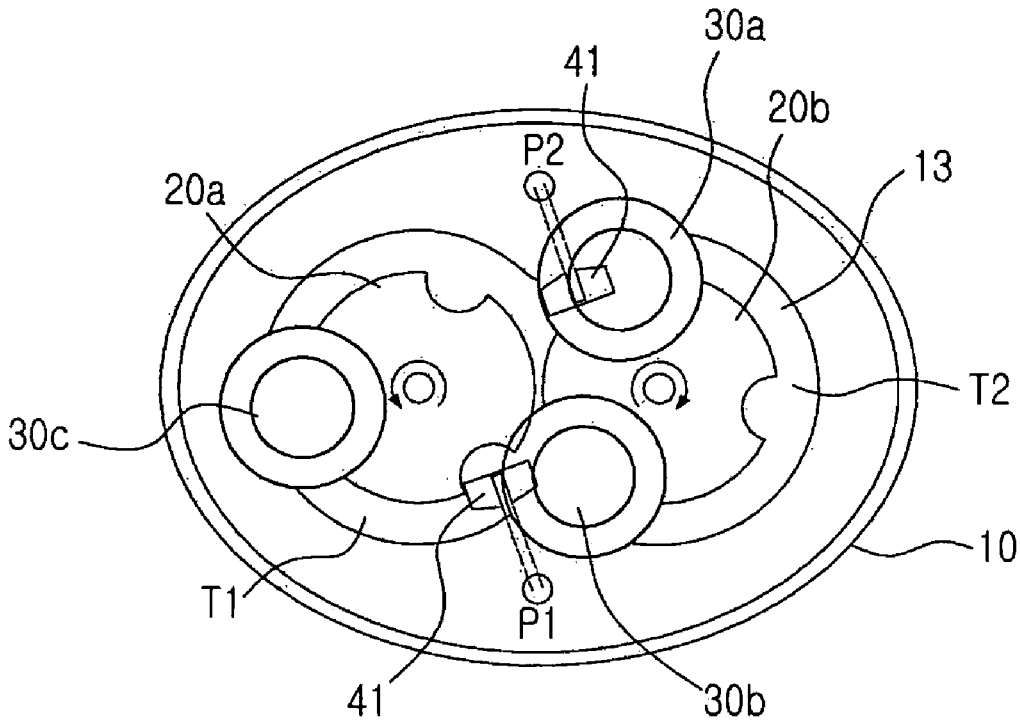

At this time, the second movable rotor 30*b* pushes the first swing plate 41, which has already been rotated in the rightward direction, in a leftward direction, and simultaneously the second swing plate 41 is pushed in a rightward direction (see FIG. 12E).

It will be understood that the second movable rotor 30*b* is subjected to a change in path like the first movable rotor 30*a*, and then makes a counterclockwise circular motion by means of the left-hand stationary rotor 20*a*.

Further, the last movable rotor 30*c* passes through the intersections P1 and P2 in the same fashion as the first and second movable rotors 30*a* and 30*b*, so that it is subjected to a change in path, and continues the circular motion from the counterclockwise direction to the clockwise direction.

In this manner, the three movable rotors 30*a*, 30*b* and 30*c* independently make a "figure-of-eight" motion along the orbital tracks T1 and T2 while the paths of the circular motion thereof are changed by the guide 40.

In particular, on the basis of the intersections P1 and P2, the movable rotors pass through the intersections in a manner such that the motion paths thereof are changed from the left-hand stationary rotor 20*a* to the right-hand stationary rotor 20*b*, and then from the right-hand stationary rotor 20*b* to the left-hand stationary rotor 20*a*, namely from left to right once, and then from right to left.

The respective movable rotors 30*a*, 30*b* and 30*c* moving as described above is coupled with the hair holding units 200.

Thus, the hair holding units 200 cross each other during movement, so that the hairs held in the hair holding units 200 are braided.

Meanwhile, the hair braiding speed can be controlled by the operation switch 54. When the hairs are nearly braided to the end, the operation switch 54 is weakly pressed to reduce the braiding speed. Thereby, the hairs can be completely braided to the end.

As is apparent from the above description, the hair braiding machine according to the present invention can braid the hair in a short period of time. Particularly, the hair braiding machine grasps the hair using the elastic force of the springs and the frictional force of the elastic tube, so that it can stably braid the hair to the end regardless of length, diameter, volume, etc. of the hair, and thus provide the convenience and stability when used.

Further, the hair braiding machine can control the magnitude of the power applied to the motor can be controlled, so that it can adjust the hair braiding speed as needed during operation.

In addition, the hair braiding machine simplifies elements for mechanical driving, so that it can reduce noise occurring when driven, and remarkably reduce the cost of production, i.e. be produced at a low cost.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hair braiding machine comprising:

a housing, which includes a motor mounted therein, a controller controlling a driving force of the motor, and orbital holes formed at an upper end of the housing, wherein the upper end of the housing has two circles having identical diameters which open in a partly overlapping form;

a pair of stationary rotors, which are installed at centers of the circles of each orbital hole such that orbital tracks are defined between the orbital hole and the stationary rotors, the stationary rotors are rotated in opposite directions by the driving force of the motor, and the stationary rotors have a plurality of insertion recesses along an outer circumference thereof at regular intervals;

a plurality of movable rotors, which are inserted into the insertion recesses of the stationary rotors along the orbital tracks, the movable rotors make a circular motion along the orbital tracks by a rotating force of the stationary rotors, the movable rotors include a fastener at an upper portion thereof from which a hair holding unit holding hairs to be braided is coupled and decoupled;

the hair holding unit has a hair holder, which has a ring at a first end of a rod extending from a grip, and into which the hairs to be braided are inserted;

a hair holding arm, which has a predetermined length, the hair holding arm holds and retains the hairs inserted into the hair holder, the hair holding arm includes a holder slit formed in an outer circumference thereof in a longitudinal direction such that the hair holder can come in and out of the hair holding arm; a grasper, which is coupled to and communicates with an upper end of the hair holding arm, and grasps the hairs retained in the hair holding arm with elastic force so as to be prevented from escaping; and a coupler, which is formed at a lower portion of the hair holding arm and is detachably installed on the fastener of each movable rotor; and a guide, which is installed at intersections of the circles of the upper orbital hole, the guide changes a path of each movable rotor reaching one of the intersections in a diagonal direction by one of the stationary rotors to make a circular motion by means of the other stationary rotor;

the guide includes a pair of swing plates and a swing lever, the swing plates are hinged at the intersections of the circles of the upper orbital hole and are installed so as to face each other on the orbital tracks; the swing lever is pivotably coupled at a center thereof, the swing lever is coupled to lower portions of the swing plates, allowing one of the swing plates to be pushed and rotated in one direction by one of the movable rotors reaching one of the intersections, and rotates the other swing plate in the other direction.

2. The hair braiding machine according to claim 1, wherein each swing plate has a protruding lever pin at the lower portion thereof, and the swing lever has pin holes at the opposite ends thereof into which the lever pins of the swing plates are inserted.

3. The hair braiding machine according to claim 1, wherein the controller includes a plurality of power supply circuits, which are connected to the motor and a power supply is connected with resistors having different resistance, and a switchboard, which sequentially connects the power supply circuits so as to adjust magnitude of power of the power supply which is applied to the motor.

4. The hair braiding machine according to claim 3, wherein:

the switchboard includes a plurality of pairs of contacts each having a first and second contact, which are connected with or disconnected from each other and are arranged in parallel at regular intervals; and the first contacts are arranged on an inner surface of an operation switch which is installed on one side of the housing so as to be rotatable when pressed, the first contacts are gradually reduced in length in a downward direction, and are sequentially connected to the second contacts according to a rotating angle of the operation switch.

5. The hair braiding machine according to claim 1, wherein the ring has an elliptical shape at the first end of the rod, and is wound one turn or one turn and a quarter.

6. The hair braiding machine according to claim 1, wherein the hair holding arm includes a guide wall, which partitions an interior of the hair holding arm in a longitudinal direction so as to hold the long hairs and guides the held hairs to be wound in upward and downward directions.

7. The hair braiding machine according to claim 6, wherein the guide wall includes an inclined wall inclined from a middle portion of an upper portion of the hair holding arm in one direction, a left-hand wall extending from the inclined wall in a downward direction, and a right-hand wall bent on the left-hand wall and extending to a proximity of the inclined wall.

8. The hair braiding machine according to claim 7, wherein the holder slit includes expansion holes at upper and lower ends thereof so as to be able to easily guide the hair holder along the guide wall.

9. The hair braiding machine according to claim 1, wherein the grasper includes:

a hollow casing, which has an elastic tube through which the hair passes, and cutout recesses formed in an outer circumference thereof in a diametrical direction;

a pair of fingers, which are coupled to hinge shafts of the casing at longitudinal middle portions of the cutout recesses, and has pressing knobs protruding inward from upper ends thereof;

springs, which are installed on lower ends of the fingers, and press the fingers such that the pressing knobs compress the elastic tube; and a slider, which is slidably installed on the outer circumference of the casing, and compresses the fingers while moving downward to release the compression of the fingers.

10. The hair braiding machine according to claim 9, wherein the grasper is coupled to the hair holding arm so as to be pivoted at a predetermined angle in all directions.

11. The hair braiding machine according to claim 9, wherein each finger has an inclined outer surface so as to be symmetrical with respect to each hinge shaft, and is selectively pressed by the springs depending on upward and downward movement of the slider.

12. The hair braiding machine according to claim 1, wherein:

the fastener of the movable rotor includes a groove; and the coupler of the hair holding arm includes at least one seat into which the fastener is inserted, the coupler has a pair of coupling buttons, each of which is rotatably installed and has a pressing part protruding outward from an upper portion thereof and a locking part protruding inward from a lower portion thereof, and a spring installed between the pressing parts.

* * * * *